US008973399B2

(12) United States Patent
Heiden et al.

(10) Patent No.: US 8,973,399 B2
(45) Date of Patent: Mar. 10, 2015

(54) LATCH MECHANISM FOR A TIMEPIECE

(75) Inventors: Kent R. Heiden, Goleta, CA (US); Kris Gielen, Lummen (BE)

(73) Assignee: Timebeads, LLC, Goleta, CA (US)

( * ) Notice: Subject to any disclaimer, the term of this patent is extended or adjusted under 35 U.S.C. 154(b) by 237 days.

(21) Appl. No.: 13/482,756

(22) Filed: May 29, 2012

(65) Prior Publication Data

US 2012/0234045 A1 Sep. 20, 2012

Related U.S. Application Data

(63) Continuation-in-part of application No. 12/212,120, filed on Sep. 17, 2008, now Pat. No. 8,225,625.

(60) Provisional application No. 61/491,105, filed on May 27, 2011.

(51) Int. Cl.

| | |
|---|---|
| ***A44C 5/00*** | (2006.01) |
| ***A44C 5/14*** | (2006.01) |
| ***A44C 5/20*** | (2006.01) |
| ***G04B 37/14*** | (2006.01) |

(52) U.S. Cl.

CPC . *A44C 5/14* (2013.01); *A44C 5/208* (2013.01); *G04B 37/1486* (2013.01)

USPC ..... 63/3; 63/23

(58) Field of Classification Search

USPC ..... 63/15.6, 15, 21, 23, 35, 3; 224/167, 224/164; 368/282, 281

See application file for complete search history.

(56) References Cited

U.S. PATENT DOCUMENTS

| | | | | |
|---|---|---|---|---|
| 3,745,788 | A * | 7/1973 | Sullivan | 63/15.6 |
| 4,353,124 | A | 10/1982 | Weinzettel et al. | |
| 7,007,507 | B2 | 3/2006 | Enevoldsen | |

FOREIGN PATENT DOCUMENTS

| | | |
|---|---|---|
| CH | 328 140 | 2/1958 |
| DE | 295 169 | 5/1916 |
| DE | 100 27 118 | 12/2001 |
| FR | 2 429 571 | 1/1980 |
| GB | 15649 | 0/1908 |
| GB | 2 195 793 | 4/1988 |

OTHER PUBLICATIONS

Michel Debard, European Search Report, Completed Nov. 25, 2010.

* cited by examiner

*Primary Examiner* — Jack W Lavinder
(74) *Attorney, Agent, or Firm* — Cislo & Thomas, LLP

(57) ABSTRACT

A charm for a chain and/or ribbon and/or belt in the form of a necklace, a bracelet or the like, characterized in that this charm is provided with a time-rendering device and optionally an insert to facilitate securement of the charm to the chain.

18 Claims, 10 Drawing Sheets

LATCH MECHANISM FOR A TIMEPIECE

CROSS-REFERENCE TO RELATED APPLICATION

This patent application is a continuation-in-part application of U.S. patent application Ser. No. 12/212,120, filed Sep. 17, 2008, now U.S Pat. No. 8,225,625 entitled "Charm for Chain, Chain and Chain Element Provided With Such a Charm," which claims the benefit of Belgian Application 2008/0230, published Apr. 16, 2008; and this patent application also claims the benefit of U.S. Provisional Patent Application No. 61/491,105, entitled "Latch Mechanism for a Timepiece," filed May 27, 2011, which applications are incorporated in their entirety here by this reference.

TECHNICAL FIELD

The present invention concerns a charm for latch mechanism on a chain for a jewelry article

BACKGROUND

In particular, the invention is intended for a chain in the form of a bracelet, a necklace or the like.

Chains for jewelry articles can be made of all sorts of materials such as for example metal, plastic, leather, wood, yarn or any other suitable material whatsoever.

Charms in the form of all sorts of figures and shapes with which a bracelet is given an exclusive and distinctive look and as a result of which the bracelet distinguishes itself from an ordinary bracelet without any charms, thus making the bracelet more unique to the user, are already known. The known charms are made of stainless steel, silver, gold, or the like, and may or may not make use of precious stones, fancy glass, or wooden beads, and the like having rather small dimensions, usually having a diameter smaller than 25 mm, preferably between 5 and 20 mm. The above-mentioned charms enable the user to continuously change his/her look by selecting charms and by providing them to a bracelet, a necklace, or the like. If the user wishes to do so, several charms according to different themes, in different materials, with different ornaments, and the like can be provided to a single chain. An example of such a chain with charms has been described in U.S. Pat. No. 7,007,507, whereby the chain is provided with means to restrict the movement of the provided charms, such that the charms do not gather around a single point of the chain, but remain nicely distributed over the chain. These means can be made in all sorts of shapes and they are not only practical, but they can also confer additional character to the chain.

Charms which are fixed to the bracelet, and which are hence selected by the manufacturer and not by the user, are known as well. When manufacturing such bracelets, a new charm or a new set of charms must be made for every new type of bracelet, which leads to relatively high production costs.

Further, it is known that people wearing a bracelet around one wrist, may wear a watch around the other wrist, which is disadvantageous in that the watch cannot be matched with the bracelet. Another disadvantage is that the watch-strap cannot be easily replaced, such that it is not practical and moreover time-consuming to select a different watch-strap every day as a function of, for example, the clothes one is wearing or the activities one will carry out.

SUMMARY

The present invention aims to remedy one or several of the above-mentioned disadvantages and/or other disadvantages by providing a charm for a chain and/or ribbon and/or belt in the form of a necklace, a bracelet or the like, whereby the above-mentioned charm is provided with a time-rendering device.

In a practical embodiment of the invention, the charm is provided with a fixing element having an assembly opening, whereby the above-mentioned fixing element can be provided around the above-mentioned chain in a detachable or permanent manner by means of the above-mentioned assembly opening.

Naturally, charms which are provided with a time-rendering device can be assembled in many different ways. For example, the fixing element may or may not have threads. In some embodiments, the fixing element may be a one-piece ring or a two-piece latch mechanism. In some embodiments, there may be a permanent connection.

The different assembly possibilities provide the user with an endless range of possible charms to choose from, provided with or without a time-rendering device, which are complementary to and can be added to other charms, as described above, and which are all attached to one and the same bracelet. The user can express him/herself via these charms and change the look, the color, and the expression of the bracelet in a simple manner by means of the charms, either with or without a time-rendering device.

In some embodiments, an advantage is that the charm is provided with a time-rendering device, and consequently functions as a watch, such that there is no need to wear a separate watch, which is cost-saving. An additional advantage is that such a charm, which may be provided with a time-rendering device, is easy to manufacture by producers of jewels and watches.

According to a preferred characteristic of the invention, the charm is provided with a fixing element with an assembly opening, and the above-mentioned fixing element is provided around the above-mentioned chain in a detachable manner by means of the above-mentioned assembly opening An advantage is that a charm which is provided with a time-rendering device, just like any other charm, can be easily replaced according to the user's taste, activities and the like.

An additional advantage is that every new type of charm which is provided with a time-rendering device can be fixed around an existing bracelet by means of the assembly opening, as a result of which the bracelets can be manufactured in larger series, leading to savings in the production costs.

In some embodiments, the charm may further comprise an insert insertable into the assembly opening to facilitate quick and easy attachment of the charm to the bracelet.

In some embodiments, the chain may be formed of two chain elements which can be connected by means of a lock, whereby at least one of the above-mentioned chain elements is provided with a charm provided with a time-rendering device, whereby the charm can be connected to at least one other chain element in a permanent or detachable manner by means of connecting means provided to that end, whereby the above-mentioned connecting means are formed of an outside thread in the above-mentioned chain element and an opening with internal screw thread provided on the above-mentioned charm.

The present invention also concerns a chain element provided with a charm whereby the charm is provided with a time-rendering device and the chain element is provided with connecting means made in the shape of a threaded connection.

An advantage is that, as the chain has already been provided with a charm with a time-rendering device, the bracelet or the necklace is functional and thus costs can be saved.

An advantage is that the design of the chain allows for mass production of the chain elements, resulting in reduced production costs.

Another advantage is that the charm with the time-rendering device can be easily produced in different variants and that the user can provide one or several of said charms to the chain as desired, depending on his/her preferences, activities or the like.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
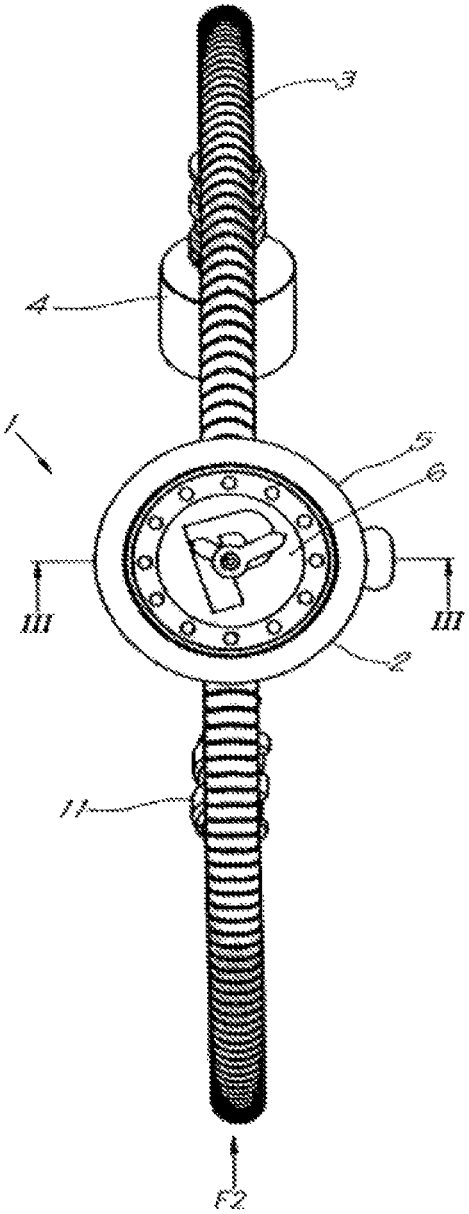
FIG. 1 shows a chain in perspective with a charm according to the invention, which is provided with a time-rendering device.

FIG. 1 represents a jewelry article 1 according to the present invention whereby the jewelry article 1 comprises a charm 2 and a chain 3. In this application, the chain 3 is the part of the jewelry article 1 that is donned on the user or wearer, and the charm 2 is the part of the jewelry article 1 that is attached to or carried by the chain 3 and provides additional or enhanced aesthetic value to the jewelry article 1. As such, the term chain includes any chain, band, cord, strap, tie, and the like. The charm 3 comprises a fixing element 7 to attach to the chain and a jewel 100 for aesthetic value. A jewel may be any article of monetary or sentimental value, such as metals, gems, stones, timepieces, and the like.

Figure 2:
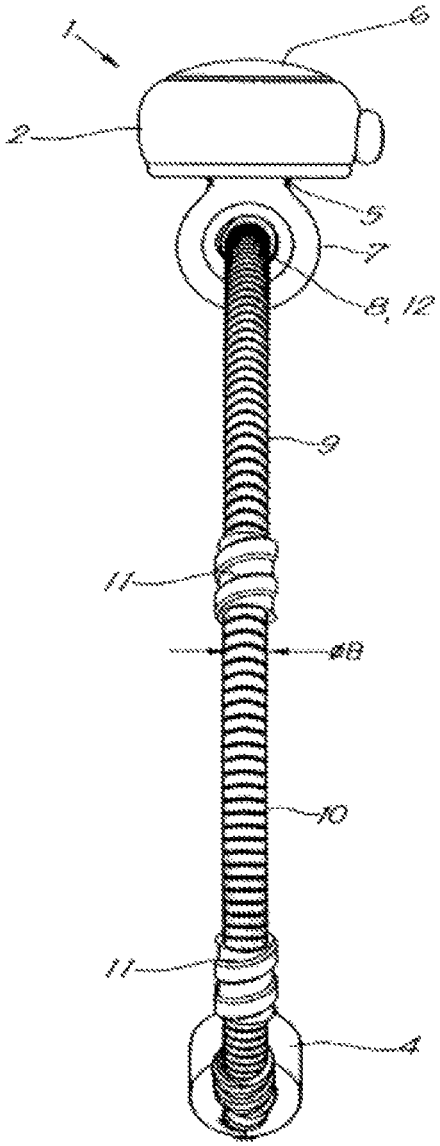
FIG. 2 represents a view according to arrow F2 in FIG. 1.

As shown in FIG. 2, the charm 2 is provided on a chain 3, and the chain 3 is made in the shape of a bracelet by way of example. Therefore, in the embodiment shown, although the chain 3 is made as a continuous strap, it can also be made as a series of several links or in the shape of a belt or a ribbon or the like. Although the embodiments in the figures always represent the chain 3 in the shape of a bracelet, it is not excluded to make the chain 3 in the shape of an anklet, a necklace, or the like.

The chain 3 may be provided with conventional locks 4 which make it possible to open and close the chain 3 so that the chain 3 can be easily put around the arm, the neck, or the like. For example, the locks 4 may be clasps, hooks, magnets, and the like. In some embodiments, the chain 3 may not have a lock as the chain 3 may be capable of fitting over the wearer's hand, head, foot, etc. For example, the chain 3 may be elastic so as to stretch over a particular body part (hand, head, foot, etc.) and then recoil back into its natural position so that it cannot slip of the body part.

In some embodiments, the chain 3 comprises two chain elements 9, 10, which can be connected to one another by means of a known lock or via the charm 2.

The chain 3 can be fixed to the charm 2, either permanently or in a detachable manner, by means of different assembly openings which will be discussed hereafter.

According to a characteristic of the invention, the charm 2 is provided with a jewel 100 shown as a timepiece or time-rendering device, which is in this case made with a circular base 5 in the conventional manner, with a dial on top over which has been provided a display window 6, but the time-rendering device 100 may have any other shape whatsoever of course, such as for example a rectangular shape, a heart shape or the like, and the dial may also be replaced by a digital display window.

According to a preferred characteristic of the invention, the dimensions of the above-mentioned display window 6 are 25 mm or smaller, preferably even smaller than 20 mm.

The charm 2 is preferably provided with a fixing element 7 comprising a ring portion 12 defining an assembly opening 8. The fixing element 7 is provided around the chain 3 in a detachable manner by means of the above-mentioned assembly opening 8.

A foundation 26 may be connected to the ring portion 12 to provide a means for securing a jewel 100 on to the fixing element 7. The foundation 26 is generally circular in shape having a first side 80 and a second side 82 opposite the first side 80. The first side 80 may be configured to receive and retain a jewel 100, while the second side 82 is connected to the ring portion 12. In some embodiments, the ring portion 12 may be integrally formed with the foundation 26.

Preferably, the fixing element 7 is provided at the bottom of the charm 2 or underneath the foundation 26, but it is not excluded for this fixing element 7 to be provided in another place on the charm 2 with the time-rendering device 100.

The above-mentioned assembly opening 8 extends through said fixing element 7, such that the charm 2, which is provided with a time-rendering device as the jewel 100, can be moved from a first chain element 9 to a second chain element 10 by screwing or turning the above-mentioned charm 2 over a stop element 11 having an outside thread, and such that the above-mentioned charm 2 can shift over the chain 3 between two successive stop elements 11 having outside threads. The chain 3 extends through the above-mentioned fixing element 7.

In a preferred embodiment, the assembly opening 8 is provided with a diameter A which is practically equal to or larger than the diameter B of the cross section of the chain 3, such that the above-mentioned charm 2 can shift over the chain 3 in the area between two successive stop elements 11 with outside thread. In some embodiments, the fixing element 7 may have the shape of a closed ring 12, such that the chain 3 can be pushed through the opening of the above-mentioned ring 12. In some embodiments, the ring 12 may have internal threads 13. Although the figures represent a circular opening in the assembly opening 8, it is not excluded for the opening to be made in another shape.

Figure 3:
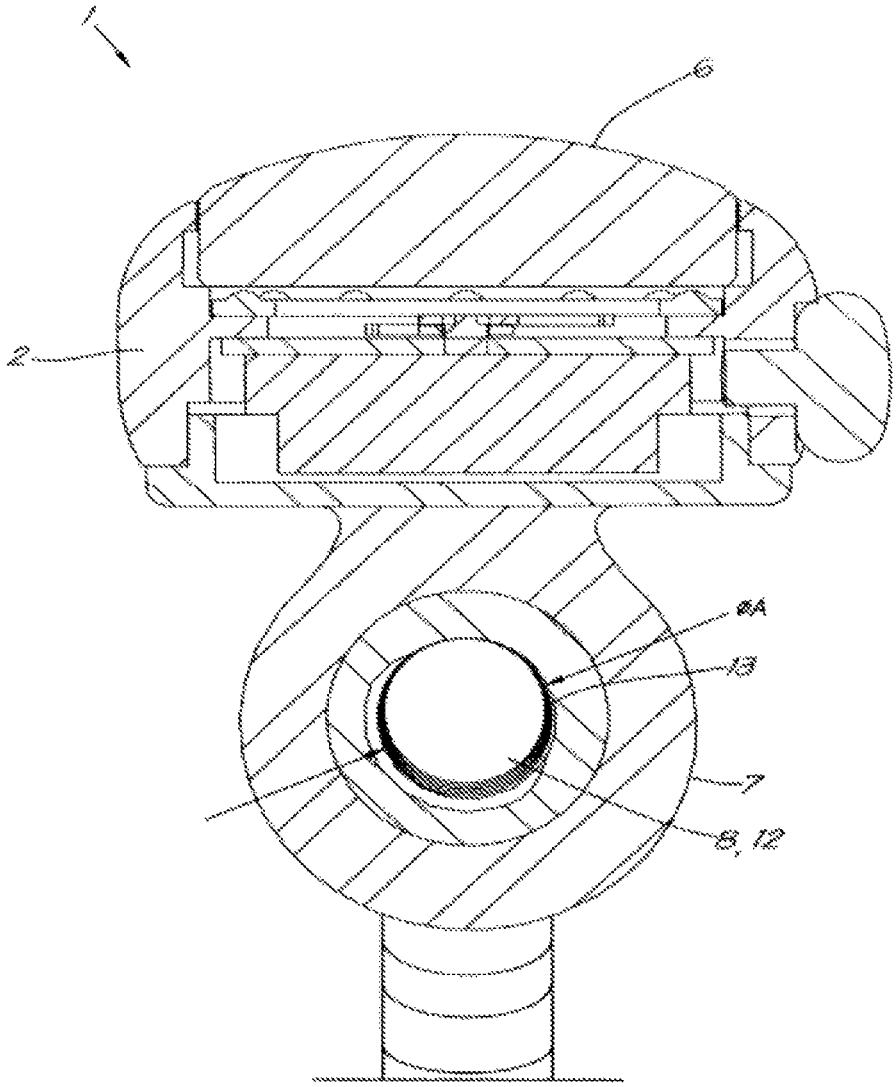
FIG. 3 represents a section according to line III-III in FIG. 1 and shows the charm in greater detail, whereby the charm is provided with a time-rendering device and is provided with an assembly opening with internal screw thread.

In some embodiments as shown in FIG. 3, the ring 12 is provided with an internal screw thread 13 with which the above-mentioned charm 2 can be screwed on or past a stop element 11 having outside threads, whereby the above-mentioned stop element 11 is part of the chain 3 According to a special characteristic of the invention, the above-mentioned charm 2 can be attached in a fixed spot by cooperating with the above-mentioned stop element 11. The method for applying a charm is very simple, as the user can thread a chain 3 with one far end through the assembly opening 8.

The fixing element 7 can be fixed to the chain 3 in such a way that the charm 1 can freely shift over the chain 3 between two stop elements 11 or it can be firmly fixed to a stop element 11 with outside thread.

In some embodiments as shown in FIGS. 4, and 7-10, the fixing element 7 of the above-mentioned charm 1 may comprise a latch part 14 which can move between an open position in which the chain 3 can be put in the assembly opening 8 and a closed position in which the chain 3 can be radially set in the above-mentioned assembly opening 8. The latch part 14 is preferably hinged to a first protruding part 17 of the fixing element 7 so as to close and open the above-mentioned assembly opening 8.

In a preferred embodiment, the latch part 14 is made in the shape of an arcuate arm 15, preferably made of a light deformable material, and it is hinge-mounted to the bottom of the time-rendering device 2, whereby the arm 15 at least partly confines the assembly opening 8 in the closed position. The arm can also be made out of a rigid material as well, such as metals, plastic, wood, etc. In the closed position, the first protruding part 17 and the latch part 14 define a portion of the ring 12.

The hinge point 16 of the arm 15 is fixed to one far end of a first protruding element 17 situated directly beneath the foundation 26, whereby this protruding element 17 confines a part of the assembly opening 8; however, the arm 15 can also be directly connected to the foundation 26.

Although the figures show an arched arm 15, it is not excluded to realize the arm 15 in a different shape, such that the assembly opening 8 is not made circular but rectangular, triangular, or any other shape, for example.

According to a preferred characteristic of the invention, the above-mentioned arm 15 is provided with locking means 18 which can lock the arm 15 in the closed position. These locking means 18 are preferably made as a leaf spring 19 provided on the above-mentioned arm 15 and extending with one part 20 past the free end of said arm 15.

On the above-mentioned part 20 of the leaf spring 19 is provided a lip 21 which can work in conjunction with an edge 22 which in this case has been provided on a second protruding element 23 at the bottom of the foundation 26. The lip 21 of the leaf spring 19 will preferably mesh behind the above-mentioned edge 22 as the arm 15 moves from the open into the closed position.

The method for applying a charm 1 according to the invention to a chain 3 is very simple and as follows. In the position represented in FIGS. 10A-10C, the arm 15 of the charm 2 is turned clockwise around the hinge point 16, such that the chain 3 can be provided in the assembly opening 8. When the chain 3 has been provided in the opening 8, the arm 15 can be put in the closed position turning the arm 15 counter-clockwise around the hinge point 16. When the arm 15 is almost in the closed position, the lip 21 of the leaf spring 19 will reach the edge 22 of the above-mentioned charm 2 and, as a result, it will be pushed in the direction of the chain 3 As the arm 15 is rotated further around the hinge point 16, the lip 21 will mesh behind said edge 22, after which the arm 15 will be situated in the above-mentioned closed position.

Figure 4:
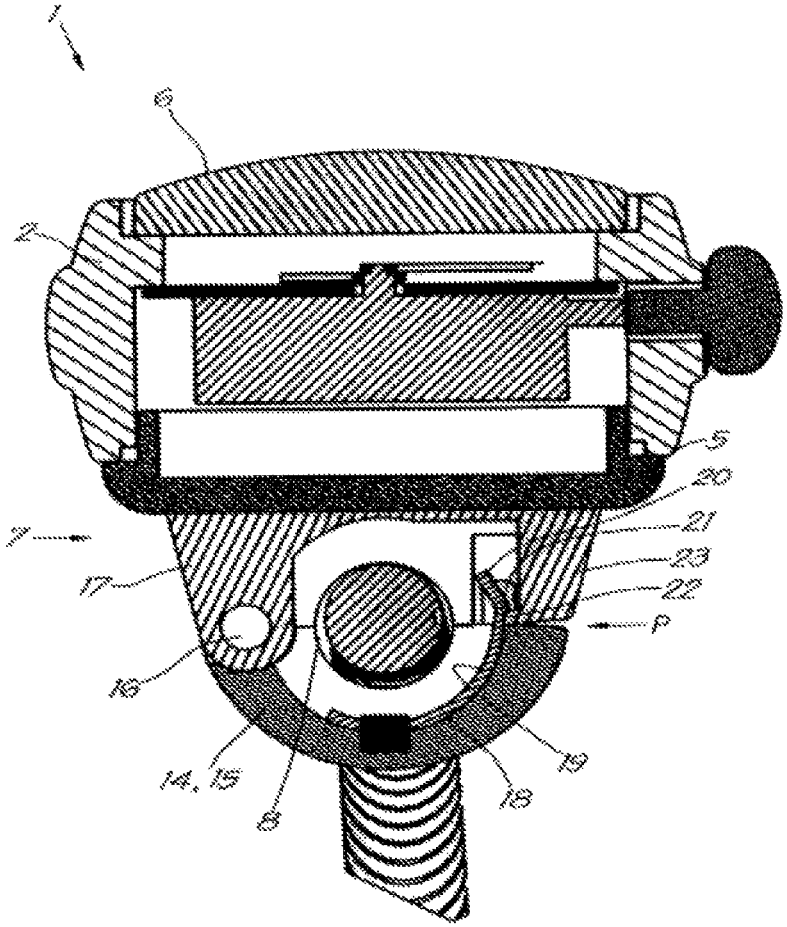
FIG. 4 represents the section of FIG. 3 in an alternative embodiment whereby the charm, which is provided with a time-rendering device, is provided with an assembly opening comprising a hinged part.
Figure 10A:
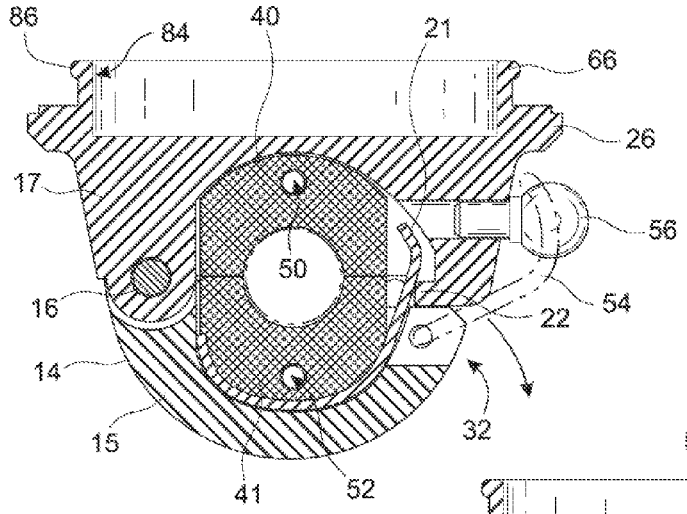
FIGS. 10A-10C show a cross-section of the embodiment of FIG. 7 transitioning from a closed configuration to an open configuration.

In order to remove the charm 2, the user will exert a force on the far end 32 of the arm 15 according to arrow P in FIGS. 4 and 10A, as a result of which the lip 21 can no longer mesh behind the edge 22 on the charm 2 and the arm 15 can be turned clockwise around the hinge point 16, such that the fixing element 7 can be put in the open position and the chain 3 can be simply removed from the assembly opening 8.

Figure 5:
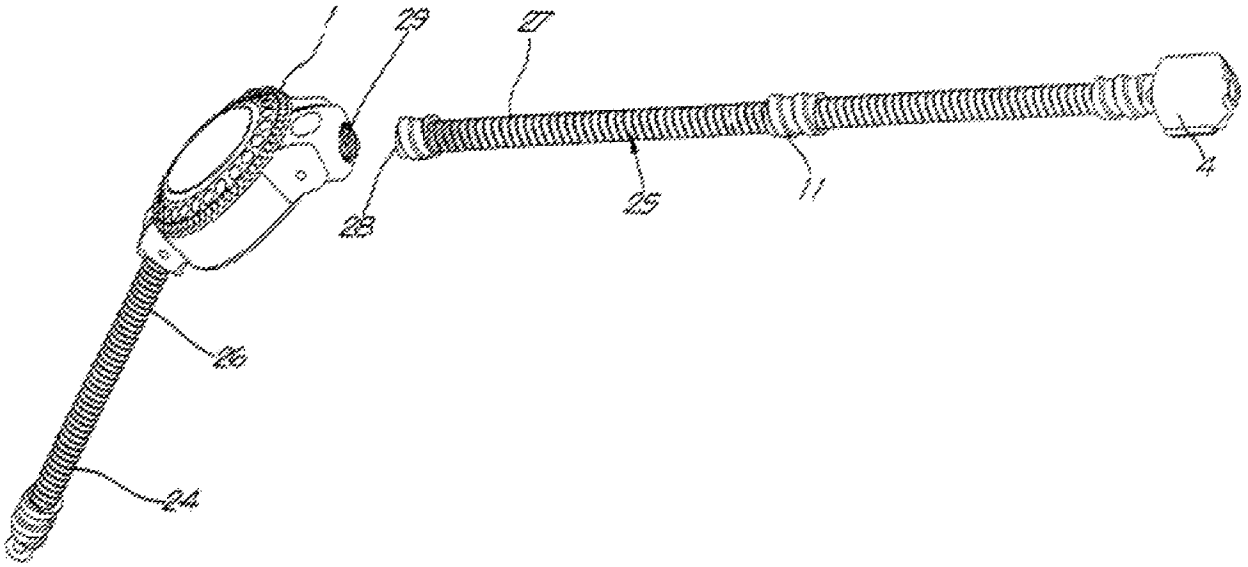
FIG. 5 is an exploded view of a chain with a charm according to the invention, whereby the chain comprises two elements, one chain element of which is connected to a charm in a detachable manner, whereby the charm is provided with a time-rendering device and with an assembly opening with internal screw thread.
Figure 6:
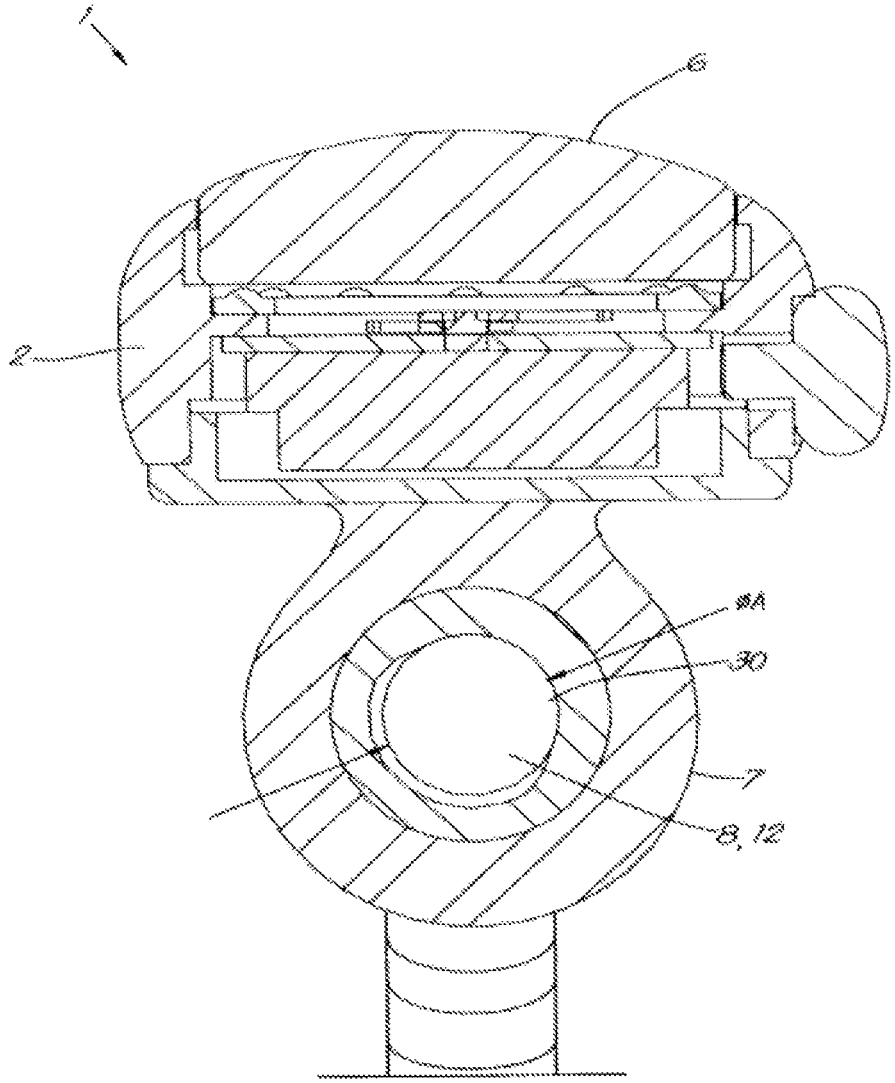
FIG. 6 represents the section of FIG. 3 in an alternative embodiment whereby the charm is provided with a time-rendering device and is provided with an assembly opening comprising a hole without internal screw thread.
Figure 7:
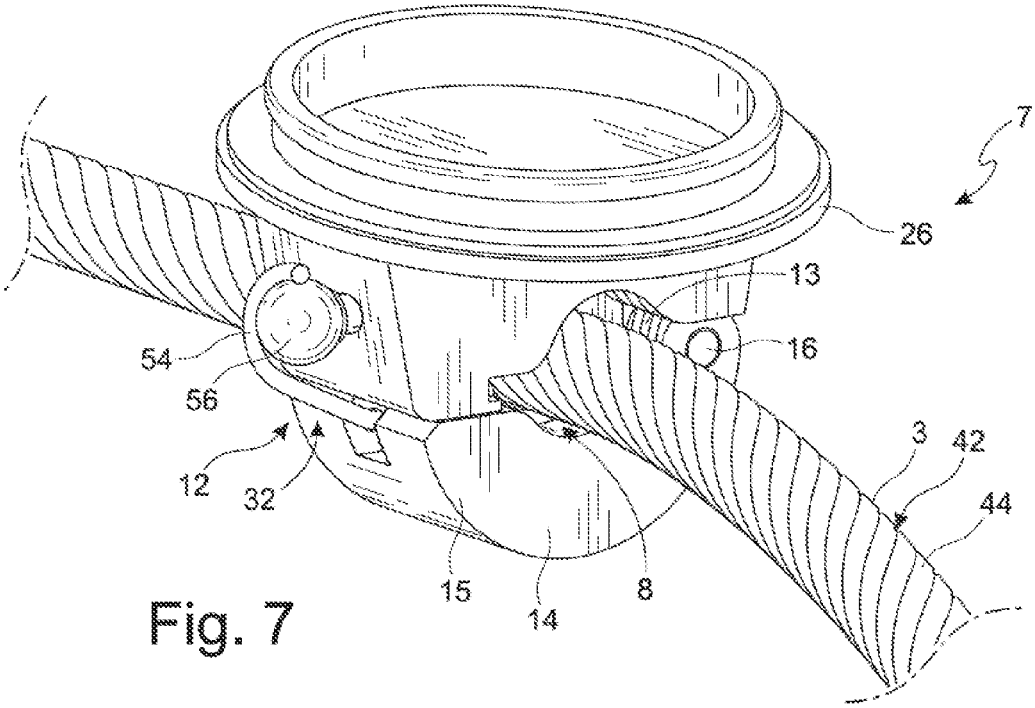
FIG. 7 represents another embodiment of the present invention without a time-rendering device for clarity with the fixing element in the open configuration.
Figure 8:
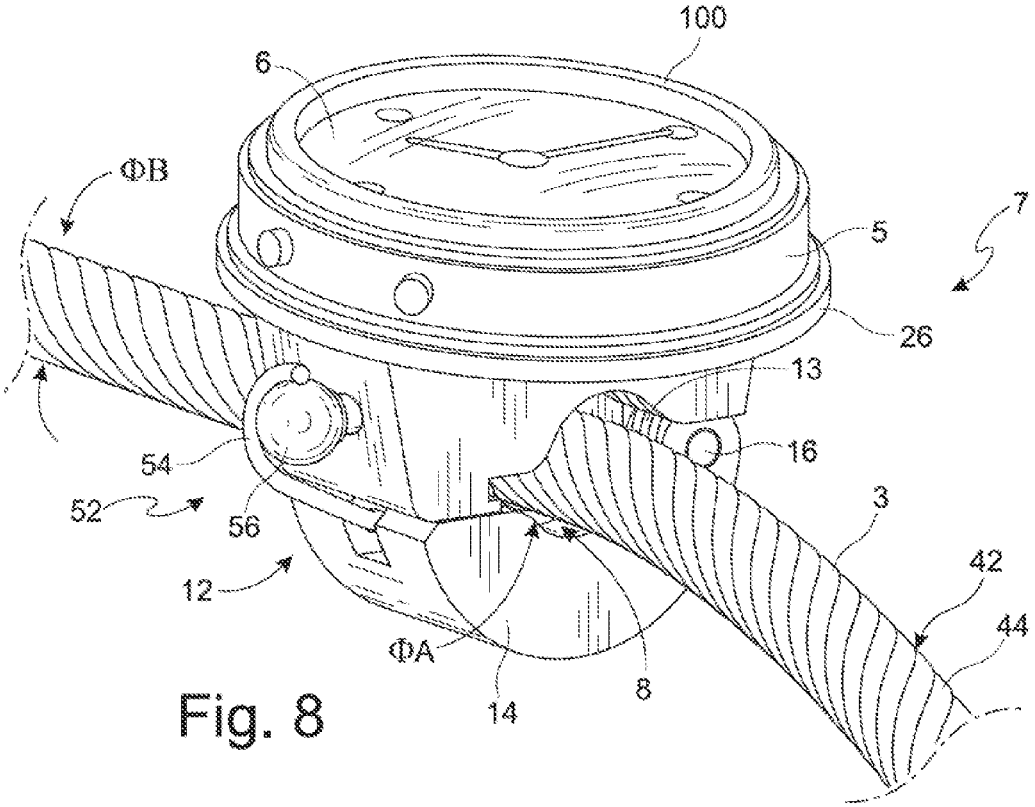
FIG. 8 represents the embodiment in FIG. 7 in the closed configuration.
Figure 9:
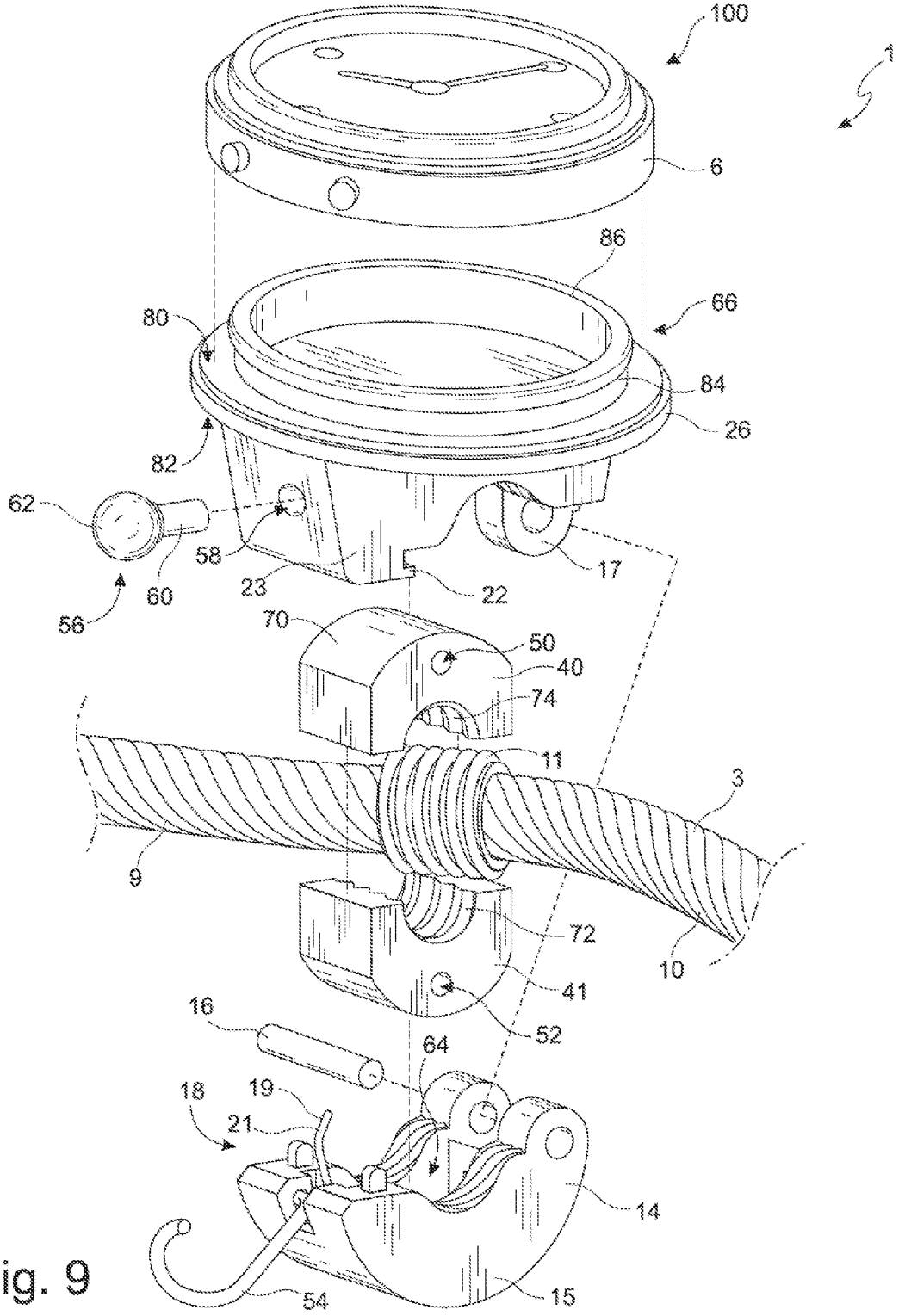
FIG. 9 represents an exploded view of the embodiment shown in FIG.8.

FIG. 5 shows an alternative embodiment of a chain 3 with a charm 2 according to the invention whereby the charm 2 comprises a time-rendering device. The chain 3 comprises two chain elements 24, 25, a first element 24 and a second chain element 25, respectively, which can be connected to one another by means of a known lock 4. In the embodiment shown, a charm 2 is provided on one far end 26 of the first chain element 24, whereby this charm 2 comprises a time-rendering device. In the given example, the charm 2 is fixed to the first chain element 24 in a non-detachable manner, for example by soldering this first chain element 24 to the above-mentioned charm 2. However, it is not excluded according to the invention to fix the above-mentioned charm 2 in a detachable manner to the chain 3, for example by means of connectors.

The above-mentioned charm 2 is in this case connected in a detachable manner to a far end 27 of the second chain element with connecting means which are preferably made in the shape of a threaded connection, whereby the above-mentioned connecting means are formed of an outside thread 28 on the above-mentioned chain element 25 and an opening 29 with internal screw thread provided on the above-mentioned charm 2.

In the given embodiment, the above-mentioned charm 2 is connected to respective chain elements 24, 25 at two diametrically opposed connection points.

It is not necessary according to the invention for the chain 3 to comprise only two chain elements 24, 25; on the contrary, it may also comprise more than two chain elements which are provided for example with a cavity with internal screw thread at one far end and with an outside thread at their other far end, such that chain elements can be coupled to one another by means of these threads.

According to a preferred characteristic of the invention, the threaded connection, formed of an outside thread, is provided on an element 11 of the above-mentioned chain element 25 and an opening 29 with internal screw thread provided in the above-mentioned charm 2. The connections between the charm 2 and the second chain element 25 and between the mutual chain elements 24, 25 must not necessarily be made as threaded connections; on the contrary, they can also be made as any other form of detachable connecting means.

The method for applying and removing a charm 2 to and from a chain 3 according to FIG. 5 is very simple as one far end 27 of the second chain element 25 can be unscrewed or screwed down in the charm 2.

In some embodiments, the present invention may further comprise a facilitating means for securing the charm 2 at a specific location along the chain 3, as shown in FIGS. 10A-12B. For example, the facilitating means for securing the charm 2 along the chain 3 may be achieved by an insert 40. The insert 40 can be configured to fit inside the fixing element 7. In such an embodiment, the fixing element 7 may or may not have threads 13. The insert 40 may be made from a pliable or compressible material such as rubber or silicon to situate itself anywhere along the chain 3 through compressive or resistive forces. Alternatively, the threading 13 and insert 40 can work in conjunction with each other.

The insert 40 may be generally circular in shape having an outer surface 70 with an outer diameter D1 and an inner surface 72 with an inner diameter D2. The outer diameter D1 of the insert 40 may be substantially the same size as the diameter B of the opening 8. In some embodiments, the outer diameter D1 of the insert 40 may be slightly larger than the diameter B of the opening 8. Having the outer diameter D1 of the insert 40 substantially similar to or slightly larger than the opening 8 of the closed ring 12 allows the insert 40 to remain inside the closed ring 12 via frictional engagement. The insert 40 may be fixed to the inner side of the ring 12, for example with adhesives, glue, and the like.

Figure 10B:
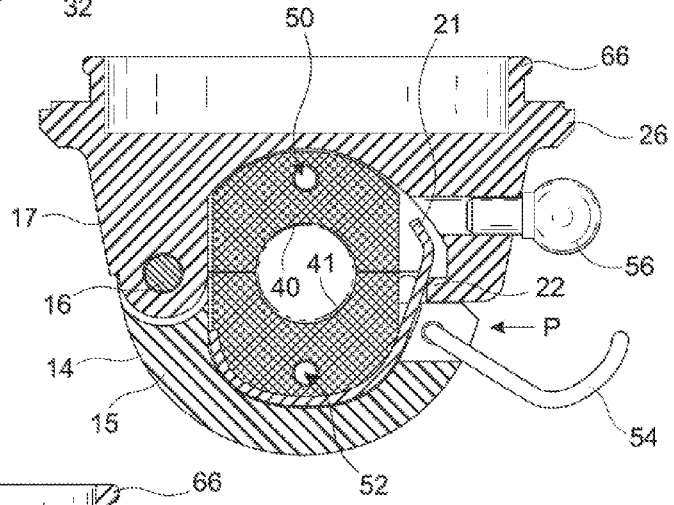
Figure 10C:
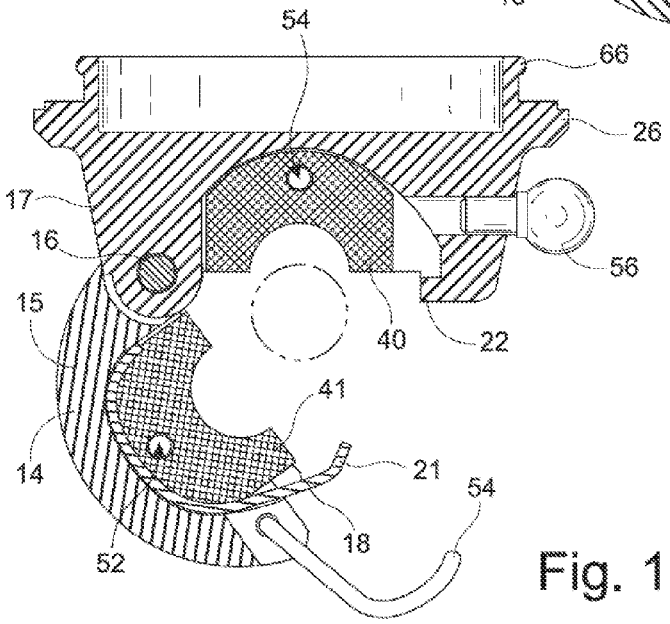
Figure 11A:
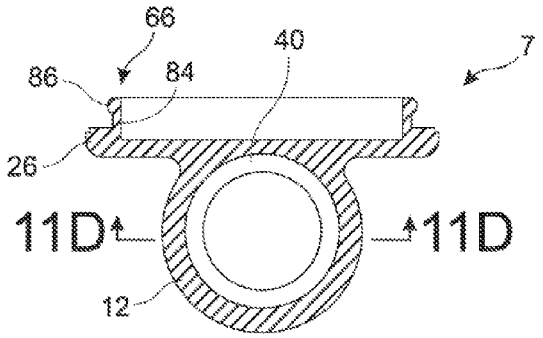
FIG. 11A shows another cross-sectional side view of another variation of the embodiment shown in FIG. 3 with the jewel and chain removed for clarity.
Figure 11B:
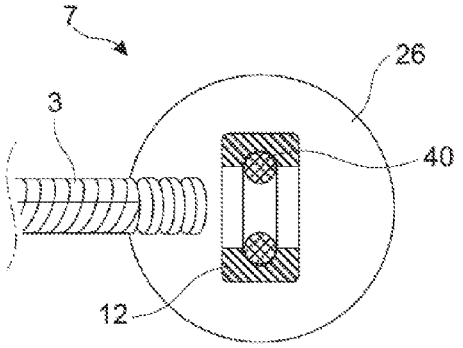
FIG. 11B is a bottom view of the embodiment shown in FIG. 11A.
Figure 11C:
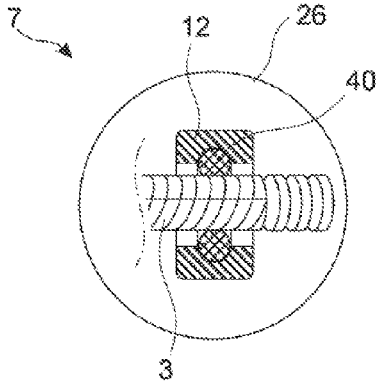
FIG. 11C is the embodiment in FIG. 11B with a chain inserted.
Figure 11D:
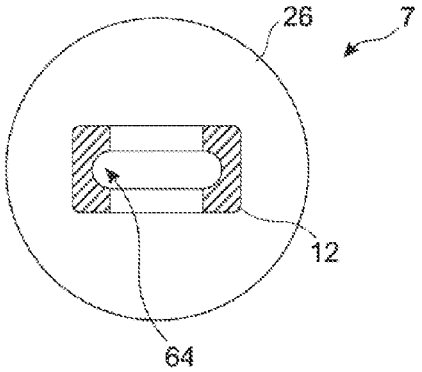
FIG. 11D is a cross-section through line 11D-11D shown in FIG. 11A.

The insert 40 can be used with other embodiments of the present invention, such as the embodiment comprising the latch part 14. In such an embodiment, the latch part 14 can be opened, the insert 40 placed inside, and the latch part 14 thereafter closed to compress the insert 40 against the chain 3, as shown in FIGS. 10A-10C. The outer surface 70 of the insert 40 can be configured to substantially correspond with the opening created by the latch 14 and the protruding element 17 so as to provide a tight fit between the insert 40, the latch part 14, and protruding element 17 when the latch 14 is in the closed configuration.

In some embodiments, the outer diameter D1 of the insert 40 maybe slightly larger than the opening created by the latch 14 and the protruding element 17. This allows the insert 40 to be compressed upon closure of the latch 14. The compression of the outer surface of the insert 40 causes the inner diameter of the inner surface of the insert 40 to compress against the chain 3, thereby, allowing the charm 12 to remain secured at the present location along the chain 3

In some embodiments, the chain 3 may comprise grooves 42 encircling the chain 3 in a transverse orientation relative to the length of the chain 3. In some embodiments, the chain 3 may comprise threads 44 spiraling along the length of the chain 3. These grooves 42 or threads 44 may be along the entire length of the chain 3, or along portions of the chain 3. In some embodiments the grooves 42 or threads 44 may be intermittently spaced apart along the chain 3 The grooves 42 or threads 44 may facilitate securement of the insert 40 to the chain 3 by allowing the inner surface of the insert 40 to mold into the grooves due to the pliable nature of the insert 40. This allows the chain to maintain its aesthetic appearance rather than utilizing a purely functional device that appears at odds with the aesthetic beauty of the chain 3.

In some embodiments, the insert 40 may also comprise reciprocal grooves or threads 74 on its inner surface 72 that allow the insert 40 to mate with the chain 3 In embodiments in which the insert 40 comprises reciprocal grooves or threads, the insert 40 may be made from other material including hard materials such as metal, plastic, wood, and the like.

Figure 12A:
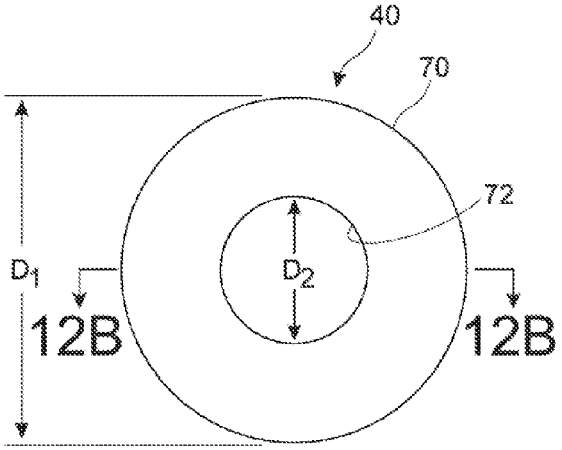
FIG. 12A is a side view of another embodiment of the O-ring.
Figure 12B:
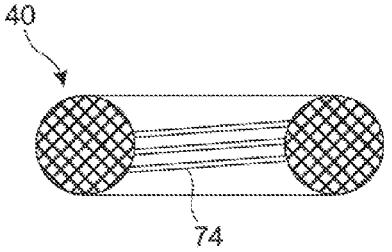
FIG. 12B is a cross-section through line 12B-12B shown in FIG. 12A.

In some embodiments, the insert 40 may be made from multiple pieces. For example, the insert 40 maybe a two-piece insert, wherein two separate pieces 40, 41 having a generally semicircular configuration are positioned next to each other and inside the fixing element 7 to form a full, circular hole. In some embodiments, the insert 40 may be a one-piece O-ring as shown in FIGS. 12A-12B. The O-ring embodiment may be combined with a one-piece fixing element 7 as shown in FIGS. 11A-11D.

In some embodiments, the inner surface of the fixing element 7 may comprise a circular groove 64 into which the insert 40 can be seated to help maintain its position. The groove 64 generally runs along the path of the inner surface of the ring 12.

In some embodiments, the insert 40 may comprise an auxiliary through-hole 50. Preferably, insert 40 comprises two auxiliary through-holes 50, 52 diametrically opposed to each other. In the two-piece embodiment, each piece 40, 41 may have a through-hole 50, 52 such that when the two pieces are assembled, the two through-holes 50, 52 are diametrically opposed to each other. The through-holes 50, 52 may improve the compressibility of the insert 40 by providing space into which the compressed insert can move.

In some embodiments, the fixing element 7 may comprise a secondary locking means in addition to the locking means 19. The secondary locking means may comprise a hook member 54, and a protruding member 56. The hook member 54 may be hingedly or rotatably attached to the latch part 14 opposite the hinge 16. The second protruding element 23 may comprise an orifice 58 through which the protruding member 56 can be inserted and fixed. The protruding member 56 has a first end 60 insertable into the orifice 58 and a second end 62 opposite the first end 60 configured to receive the hook member 54. In some embodiments, the diameter of the protruding member 56 at the second end 62 may be greater than the diameter of the protruding member 56 at the first end 60. For example, the second end 62 may terminate in a bulbous configuration so as to prevent the hook member 54 from inadvertently sliding off the protruding member 56 when locked in place. In some embodiments, the secondary locking means may be the primary locking mechanism without the need for locking means 19. Many other locking mechanisms can be utilized.

In some embodiments, the foundation 26 may be configured to receive a variety of different jewels 100 including timepieces, gems, stones, metals, trinkets, and the like. For example, the foundation 26 may comprise a retention mechanism 66, which may be a cylindrical wall 84, a flanged lip 86, a cylindrical wall 84 with a flanged lip 86, a lip or wall with threading, a lip or wall with holes or recesses, or any other type of protruding wall or lip or any combination thereof onto which the time-rendering device 2, or charm-like device can be removably connected to the retention mechanism by snapping, screwing, or latching, and the like. The bottoms of the jewels may also be configured accordingly or fitted with a receiving mechanism to receive and reversibly lock onto the retention mechanism 66. Alternatively, the jewel 100 may comprise the retention mechanism 66 and the foundation 26 may comprise the receiving mechanism. These features allow the jewel to removably attach to the foundation 26, for example, by screwing on, clipping on, latching on, squeezing on, or otherwise fastening on to the foundation 26. Therefore, users having multiple jewels can swap out one for another without removing the chain 3 from her person.

The present invention is by no means restricted to the embodiments described as an example and represented in the drawings; on the contrary, a charm 2, a chain 3, and a chain element according to the invention can be made in all sorts of variants while still remaining within the scope of the invention.

What is claimed is:

1. A jewelry article, comprising:

a. a chain, comprising a stop element; and b. a charm, comprising a fixing element attached to a jewel, the fixing element comprising:

i. a foundation having a first side and a second side opposite the first side, the first side configured to retain the jewel;

ii. a ring portion fixed to the foundation at the second side in a perpendicular orientation, the fixing element being generally circular in shape and having an inner surface defining an assembly opening, the fixing element being mountable around a chain in a movable manner, thereby, locating the chain in the assembly opening; and c. an insert comprising an outer surface conforming to the assembly opening of the fixing element and an inner surface defining a main hole through which the chain can be inserted, wherein the insert further comprises an auxiliary hole.

2. A jewelry article, comprising:

a. a chain, comprising a stop element; and b. a charm, comprising a fixing element attached to a jewel, the fixing element comprising:

i. a foundation having a first side and a second side opposite the first side, the first side configured to retain the jewel;

ii. a ring portion fixed to the foundation at the second side in a perpendicular orientation, the fixing element being generally circular in shape and having an inner surface defining an assembly opening, the fixing element being mountable around a chain inaremovable manner, thereby, locating the chain in the assembly opening; and c. an insert comprising an outer surface conforming to the assembly opening of the fixing element and an inner surface defining a main hole through which the chain can be inserted, wherein the insert comprises two pieces.

3. A jewelry article, comprising:

a. a chain, comprising a stop element;

b. a charm, comprising a fixing element attached to a jewel, the fixing element comprising:

i. a foundation having a first side and a second side opposite the first side, the first side configured to retain the jewel;

ii. a ring portion fixed to the foundation at the second side in a perpendicular orientation, the fixing element being generally circular in shape and having an inner surface defining an assembly opening, the fixing element being mountable around a chain in a removable manner, thereby, locating the chain in the assembly opening; and c. an insert comprising an outer surface conforming to the assembly opening of the fixing element and an inner surface defining a main hole through which the chain can be inserted, wherein the fixing element includes a part moveable between an open position and a closed position, wherein in the open position the chain can be disposed in the assembly opening, and in the closed position the chain is set in the assembly opening in such a way as to allow the fixing element to freely shift over the chain.

4. The jewelry article of claim 3, wherein the fixing element comprises an internal screw thread, wherein the stop element of the chain comprises an outside screw thread configured such that when the stop element is disposed within the fixing element, the charm is firmly fixed in place on the stop element, but enabled to be screwed on or past the stop element.

5. The jewelry article of claim 4, wherein the inner surface of the fixing element comprises a groove configured to receive the insert.

6. The jewelry article of claim 3, wherein the foundation comprises a retention mechanism configured to reversibly secure the jewel to the foundation.

7. A latch mechanism for a jewelry article, comprising a fixing element, the fixing element, comprising:

a. a foundation having a first side and a second side opposite the first side, the first side configured to retain a jewel;

b. a ring portion fixed to the foundation at the second side in a perpendicular orientation, the fixing element being generally circular in shape and having an inner surface defining an assembly opening, the fixing element being mountable around a chain in a removable manner, thereby, locating the chain in the assembly opening; and c. an insert comprising an outer surface conforming to the assembly opening of the fixing element and an inner surface defining a main hole through which the chain can be inserted, wherein the insert further comprises an auxiliary hole.

8. A latch mechanists for a jewelry article, comprising a fixing element, the fixing element, comprising:

a. a foundation having a first side and a second side oppsosite the first side, the side configured to retain a jewel;

b. a ring portion fixed to the foundation at the second side in a perpendicular orientation, the fixing element being generally circular in shape and having an inner surface defining an assembly opening, the fixing element being mountable around a chain in a removable manner, thereby, locating the chain in the assembly opening; and c. an insert comprising an outer surface conforming to the assembly opening of the fixing element and an inner surface defining a main hole through which the chain can be inserted, wherein the insert comprises two pieces.

9. A latch mechanists for a jewelry article, comprising a fixing element, the fixing element, comprising:

a. a foundation having a first side and a second side opposite the first side, the first side configured to retain a jewel;

b. a ring portion fixed to the foundation at the second side in a perpendicular orientation, the fixing element being generally circular in shape and having an inner surface defining an assembly opening, the fixing element being mountable around a chain in a removable manner, thereby, locating the chain in the assembly opening; and c. an insert comprising an outer surface conforming to the assembly opening of the fixing element and an inner surface defining a main bole through which the chain can be inserted, wherein the fixing element includes a part moveable between an open position and a closed position, wherein in the open position a chain can be disposed in the assembly opening, and in the closed position the chain is set in the assembly opening in such a way as to allow the fixing element to freely shift over the chain.

10. The jewelry article of claim 9, wherein the inner surface the fixing element comprises a groove configured to receive the insert.

11. The jewelry article of claim 9, wherein the fixing element comprises an internal screw thread, wherein a stop element of a chain comprises an outside screw thread configured such that when the stop element is disposed within the fixing element, the charm is firmly fixed in place on the stop element, but enabled to be screwed on or past the stop element.

12. The jewelry article of claim 9, wherein the foundation comprises a retention mechanism configured to reversibly secure the jewel to the foundation.

13. A latch mechanism for a jewelry article comprising a fixing element, the fixing element, comprising:

a. a foundation having a first side and a second side opposite the first side, the first side configured to retain a jewel;

b. a ring portion fixed to the foundation at the second side in a perpendicular orientation, the fixing element being generally circular in shape and having an inner surface defining an assembly opening, the fixing element being mountable around a chain in a removable manner, thereby, locating the chain in the assembly opening, wherein the ring portion comprises a part moveable between an open position and a closed position, wherein in the open position the chain can be disposed in the assembly opening, and in the closed position the chain is set in the assembly opening in such a way as to allow the fixing element to freely shift over the chain; and c. an insert comprising an outer surface conforming to the assembly opening of the fixing element and an inner surface defining a main hole through which the chain can be inserted.

14. The jewelry article of claim 13, wherein the inner surface of the fixing element comprises a groove configured to receive the insert.

15. The jewelry article of claim 13, wherein the insert further comprises an auxiliary hole.

16. The jewelry article of claim 13, wherein the insert comprises two pieces.

17. The jewelry article of claim 13, wherein the fixing element comprises an internal screw thread configured to nate with a stop element of the chain, the stop element comprising an outside screw thread configured such that when the stop element is disposed within the fixing element, the charm is firmly fixed in place on the stop element, but enabled to be screwed on or past the stop element.

18. The jewelry article of claim 13, wherein the foundation comprises a retention mechanism configured to reversibly secure a jewel to the foundation.

* * * * *